United States Patent [19]

Takada et al.

[11] Patent Number: 4,783,398

[45] Date of Patent: Nov. 8, 1988

[54] PHOTOGRAPHIC SILVER HALIDE EMULSION CONTAINING TABULAR GRAINS OF HIGH CHLORIDE CONTENT

[75] Inventors: Shunji Takada; Hiroyuki Mifune; Tadashi Ikeda, all of Kanagawa, Japan

[73] Assignee: Fuji Photo Film Co., Ltd., Kanagawa, Japan

[21] Appl. No.: 64,974

[22] Filed: Jun. 22, 1987

[30] Foreign Application Priority Data

Jun. 20, 1986 [JP] Japan ..... 61-144228

[51] Int. Cl.[4] ..... G03C 1/02; G03C 1/08; G03C 7/26; G03C 7/32

[52] U.S. Cl. ..... 430/567; 430/495; 430/496; 430/543; 430/552; 430/553; 430/554; 430/555; 430/556; 430/557; 430/558; 430/569; 430/576; 430/577; 430/581

[58] Field of Search ..... 430/567, 569, 495, 496, 430/543, 552, 553, 554, 555, 556, 557, 558, 576, 577, 581

[56] References Cited

U.S. PATENT DOCUMENTS

| | | | |
|---|---|---|---|
| 4,399,215 | 8/1963 | Wey | 430/567 |
| 4,400,463 | 8/1983 | Maskasky | 430/434 |
| 4,452,882 | 6/1984 | Akimura et al. | 430/567 |
| 4,585,733 | 4/1986 | Ezaki et al. | 430/567 |
| 4,621,041 | 11/1986 | Saikawa et al. | 430/567 |

FOREIGN PATENT DOCUMENTS

| | | | |
|---|---|---|---|
| 1120765 | 3/1982 | Canada | 430/567 |

*Primary Examiner*—Mukund J. Shah

*Attorney, Agent, or Firm*—Sughrue, Mion, Zinn, Macpeak, and Seas

[57] ABSTRACT

A photographic silver halide emulsion is disclosed, comprising high silver chloride content tabular grains wherein at least 50 mol % of the silver halide is silver chloride and at least 50%, based on the total projected area of emulsion grains, are tabular grains having a ratio of diameter corresponding to a circle of the projected area to thickness of from 2/1 to 10/1.

13 Claims, No Drawings

PHOTOGRAPHIC SILVER HALIDE EMULSION CONTAINING TABULAR GRAINS OF HIGH CHLORIDE CONTENT

FIELD OF THE INVENTION

The present invention relates to photographic silver halide emulsions. More particularly, it is concerned with silver halide emulsions containing tabular silver chloride grains, or silver chlorobromide, silver chloroiodide, or silver chloroiodobromide grains having a high silver chloride content.

BACKGROUND OF THE INVENTION

It is well known to those skilled in the art that grains having a grain diameter which is much greater than their grain thickness, i.e., so-called tabular grains, are desirable to increase the sensitivity of a silver halide photographic emulsion and further to increase sharpness, granularity, color sensitization efficiency, covering power in conjunction with a sensitizing dye, and so forth.

Furthermore, if the silver chloride content is increased, water-solubility is increased and development and fixing are achieved in a shorter time, leading to the production of silver halide suitable for rapid processing.

Silver halide grains having a high silver chloride content (hereinafter referred to as "high silver chloride content grains") generally tend to formed as cubic grains. Thus some special techniques are needed to produce such as tabular grains. In connection with high silver chloride content tabular grains having a silver chloride content of more than 50 mol%, only two methods have been known. One of the methods is described in U.S. Pat. No. 4,399,215 in which grain formation is performed using ammonia with no introduction of bromide and iodide in the inside of grain and while maintaining the pAg within the range of 6.5 to 10 and the pH within the range of from 8 to 10, and the other is described in U.S. Pat. No. 4,400,463 in which grain formation is performed in the presence of aminoazaindene and a peptizer having a thioether bond.

The methods described in the above U.S. Patents directed the preparation of silver chloride tabular grains having a high aspect ratio and large grain size, which can be easily understood from their examples. An emulsion having a high aspect ratio and a large grain size is advantageous with respect to the sensitization because the amount of a spectral sensitizing dye to be adsorbed per grain can be increased, but such is not always preferred as an emulsion for rapid developing processing, which is aimed at in the present invention. Furthermore, an emulsion having a high aspect ratio and a large grain size has serious disadvantages in handling, such as pressure marks and pressure desensitization which are characteristic of tabular grains. Thus, the emulsion is not always preferred from a practical standpoint.

Under the above circumstances, it has been desired to develop high silver chloride content grains which possess, as well as the fundamental properties that sensitivity is high and fog is reduced, suitability for rapid developing processing, and also better satisfy the practical requirements that granularity is good, pressure resistance of the grains is good, and so forth.

SUMMARY OF THE INVENTION

One object of the present invention is to provide a tabular grain silver halide emulsion having a high silver chloride content, which is suitable for use in rapid developing processing, i.e., is rapidly developed and has a good sensitivity/fog ratio.

Another object of the present invention is to provide a tabular grain silver halide emulsion having a high silver chloride content which can solve the above practical problems such as pressure marks and pressure desensitization.

That is, the present invention relates to a photographic silver halide emulsion comprising high silver chloride content tabular grains wherein at least 50 mol% of all silver halide is a chloride and at least 50%, based on the total projected area of emulsion grains, are the tabular grains having a ratio of grain diameter corresponding to a circle of the projected area to grain thickness of from 2/1 to 10/1.

DETAILED DESCRIPTION OF THE INVENTION

The high silver chloride content tabular grains to be used in the present invention refers to those grains having a silver chloride content of at least 50 mol%, preferably at least 70 mol%, and more preferably at least 90 mol%.

The remainder comprises silver bromide and/or silver iodide. The silver iodide content is generally not more than 20 mol%, and preferably not more than 10 mol%. Particularly preferred is an emulsion which does not substantially contain silver iodide, and in which a layer mainly made of silver bromide is localized in the neighborhood of the grain surface.

The localized layer which is made mainly of silver bromide can be formed, after formation of high silver chloride content grains, by adding a water-soluble silver salt and a water-soluble bromide salt and then forming a shell on the grain, or by adding only a water-soluble bromide salt and performing heat aging.

The localized layer which is made mainly of silver bromide can be formed at any desired point before the water-washing step, or before or after chemical sensitization, or before coating. The amount of the silver bromide in the localized layer is generally from 0.01 to 10 mol%, preferably from 0.1 to 3 mol% based on the total weight of all silver halide. The silver bromide content of the localized layer must be greater than the average silver bromide content of high silver chloride content grains. The silver bromide content is preferably not less than 50 mol%, and more preferably not less than 70 mol%. That is, the silver bromide content of the localized layer must be greater than the average silver bromide content of high silver chloride content grains by not less than 20 mol%, preferably not less than 40 mol%, and particularly preferably not less than 60 mol%. The existence of the localized layer can be analyzed by surface analysis techniques such as XPS (X-ray Photoelectron Spectroscopy).

A description of the XPS method can be found in J. Aihara et al, *Denshi no Bunkou* (*Electron Spectroscopy*), Kyoritsu Library 16, published by Kyoritsu Shuppan, Tokyo, 1978.

In the photographic silver halide emulsion of the present invention which contains high silver halide content tabular grains, at least 50% based on the total projected area of all emulsion grains are high silver chloride content tabular grains having a ratio of grain diameter corresponding to a circle of the projected area to grain thickness (hereinafter referred to as the "aspect ratio") of from 2/1 to 10/1.

It is preferred for the high silver chloride content tabular grains having an aspect ratio of from 2/1 to 10/1 to constitute at least 70% based on the total projected area of all emulsion grains, with the range of not less than 90% being more preferred.

The average aspect ratio of high silver chloride content tabular grains is preferably from 3/1 to 10/1, more preferably from 3/1 to 8/1, and particularly preferably from 5/1 to 8/1.

If there are a great number of grains having an aspect ratio of less than 2/1, the color sensitization sensitivity is low. On the other hand, if there are a great number of grains having an aspect ratio of more than 10/1, the developing speed is low and practical problems such as pressure properties (e.g., pressure marks and pressure desensitization) occur.

In the present invention, the average diameter of the high silver chloride content tabular grains (i.e., the tabular silver halide grains) is preferably from 0.5 to 3.0 μm.

The average thickness of the tabular silver halide grains is preferably not more than 0.3 μm, and more preferably not more than 0.2 μm.

In general, tabular silver halide grains are in the form of a plate having two parallel surfaces. Thus the term "thickness" as used herein means the distance between the two surfaces of the tabular silver halide grains.

The average volume weighted by volume of the grains is preferably not more than 2 $\mu m^3$, and more preferably not more than 0.8 $\mu m^3$.

The average volume ($\overline{V}$) weighted by volume is represented by the formula $$\overline{V} = \frac{\Sigma(n_i V_i) V_i}{\Sigma n_i V_i}$$

wherein $n_i$ is the number of grains, and $V_i$ is volume of one grain.

The high silver chloride content tabular grains of the present invention may be of the inner latent image type or of the surface latent image type.

In connection with the preparation of emulsion comprising the high silver chloride content tabular grains of the present invention, it is preferred that the grain formation be carried out in the presence of a low molecular weight compound represented by formula (I)

(I)

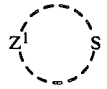

wherein $Z^1$ is an atomic group forming a substituted or unsubstituted saturated or unsaturated heterocyclic ring in combination with a sulfur atom.

The atomic group represented by $Z^1$ comprises a carbon atom, a nitrogen atom, an oxygen atom, and a sulfur atom. The heterocyclic ring formed from $Z^1$ and a sulfur atom is a 3- to 8-membered heterocyclic ring. This heterocyclic ring may be attached to another ring so as to form a condensed ring.

Representative examples are thiirane, thioethane, thiane, thiepin, thiocin, dihydrothiorane, thiophene, dihydrothiopyrane, 4H-thiopyrane, 2H-thiopyrane, 1,3-thiazolidine, thiazole, 1,3-oxathiolan, 1,3-dithiolan, 1,3-dithiolene, 1,4-oxathiane, 1,4-thiazan, 1,3-thiazan, benzothiolan, benzothiane, benzothiazolidine, and benzoxathiane.

Examples of substituents for the heterocyclic ring formed by $Z^1$ and a sulfur atom include a halogen atom (e.g., a fluorine atom, a chlorine atom, and a bromine atom), an alkyl group (preferably having from 1 to 20 carbon atoms), an aryl group (preferably having from 6 to 20 carbon atoms), an alkoxy group (preferably having from 6 to 20 carbon atoms), an aryloxy group (preferably having from 6 to 20 carbon atoms), alkylthio group (preferably having from 1 to 20 carbon atoms), an arylthio group (preferably having from 1 to 20 carbon atoms), an acyloxy group (preferably having from 2 to 20 carbon atoms), an amino group (e.g., an unsubstituted amino group, preferably sec- or tert-amino group substituted by an alkyl group having from 1 to 20 carbon atoms or an aryl group having from 6 to 20 carbon atoms), a carbonamido group (preferably an alkylcarbonamido group having from 1 to 20 carbon atoms or an arylcarbonamido group having from 6 to 20 carbon atoms), a ureido group (preferably an alkylureido group having from 1 to 20 carbon atoms or an arylureido group having from 6 to 20 carbon atoms), a carboxyl group, a carbonic acid ester group (preferably an alkylcarbonic acid ester group having from 1 to 20 carbon atoms or an arylcarbonic acid ester group having from 6 to 20 carbon atoms), an oxycarbonyl group (preferably an alkyloxycarbonyl group having from 1 to 20 carbon atoms or an aryloxycarbonyl group having from 6 to 20 carbon atoms), a carbamoyl group (preferably an alkylcarbamoyl group having from 1 to 20 carbon atoms or an arylcarbamoyl group having from 6 to 20 carbon atoms), an acyl group (preferably an alkylcarbonyl group having from 1 to 20 carbon atoms or an arylcarbonyl group having from 6 to 20 carbon atoms), a sulfo group, a sulfonyl group (preferably an alkylsulfonyl group having from 1 to 20 carbon atoms or an arylsulfonyl group having from 6 to 20 carbon atoms), a sulfinyl group (preferably an alkylsulfonyl group having from 1 to 20 carbon atoms or an arylsulfonyl group having from 6 to 20 carbon atoms), a sulfonamide group (preferably an alkylsulfonamide group having from 1 to 20 carbon atoms or an arylsulfonamide group having from 6 to 20 carbon atoms), a sulfamoyl group (preferably an alkylsulfamoyl group having from 6 to 20 carbon atoms or an arylsulfamoyl group having from 6 to 20 carbon atoms), a cyano group, a hydroxyl group, a nitro group, an oxo group, a thiooxo group, an imino group, and a selenoxo group.

When the heterocyclic ring is substituted by two or more groups, the groups may be the same or different.

Of the compounds represented by formula (I), those represented by formula (II) are preferred.

(II)

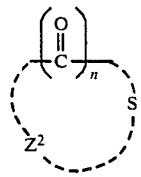

In formula (II), $Z^2$ represents an unsubstituted or substituted atomic group forming a 5- or 6-membered saturated or unsaturated heterocyclic ring in combination with a sulfur atom and a carbonyl group, and n represents 1, 2, or 3.

The atomic group represented by $Z^2$ and the heterocyclic ring formed from $Z^2$, a sulfur atom and a carbonyl group may be substituted by the same substituent(s) as listed for $Z^1$ and the heterocyclic ring formed by $Z^1$ and a sulfur atom.

When n is 2 or 3, the carbonyl groups may or may not be adjacent to each other.

Representative examples of the 5- or 6-membered saturated or unsaturated heterocyclic rings represented by formula (II) are shown below.

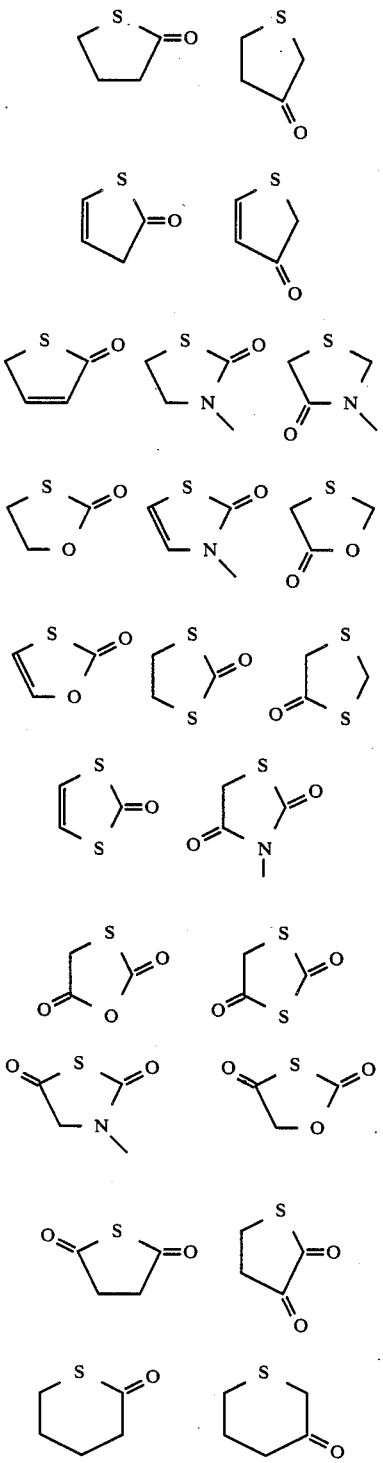

-continued

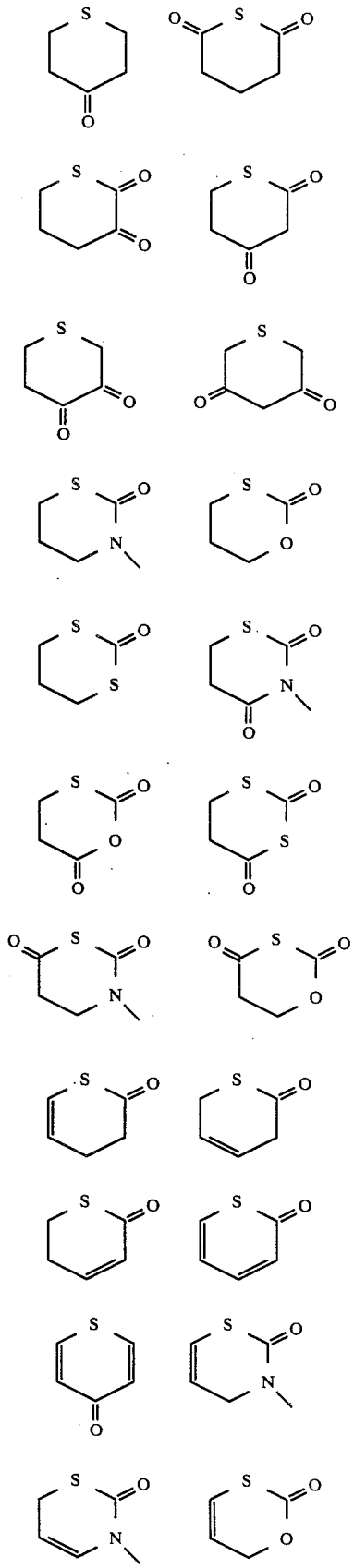

-continued

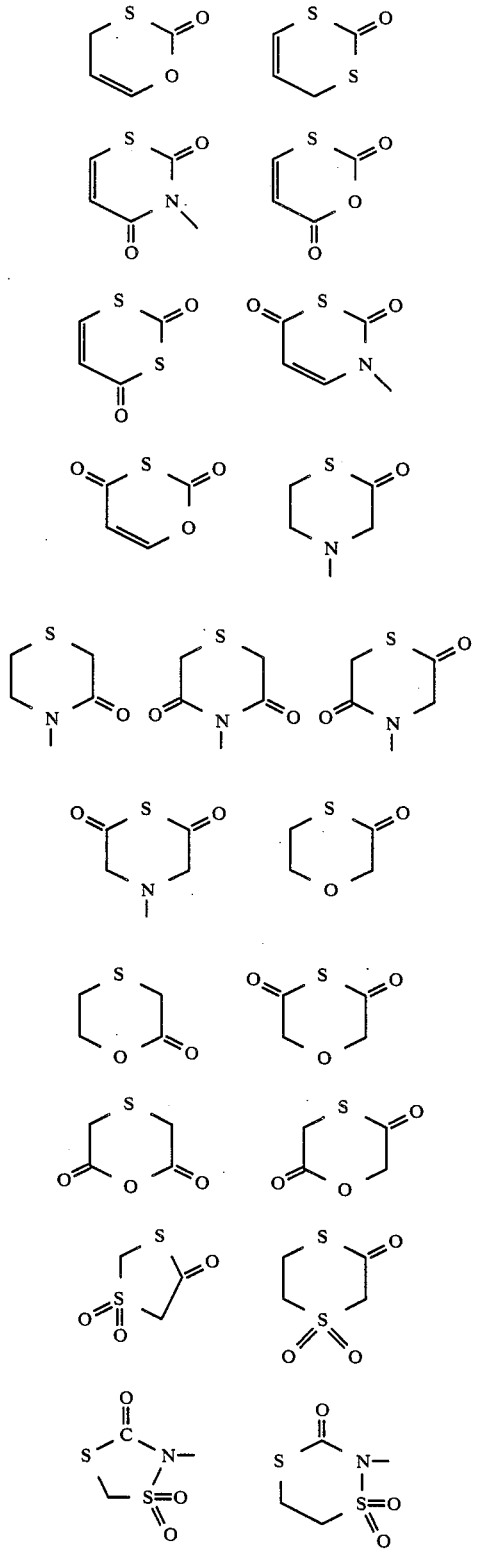

Of the compound represented by formula (II), those wherein a carbonyl group is linked by a sulfur, and the thus obtained heterocyclic rings are saturated, are particularly preferred.

Representative examples of the compound represented by formula (I) are shown below.

Compound 1

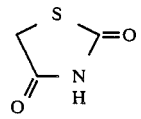

Compound 2

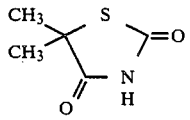

Compound 3

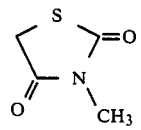

Compound 4

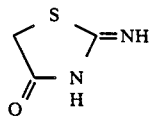

Compound 5

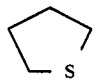

Compound 6

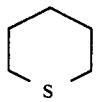

Compound 7

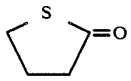

Compound 8

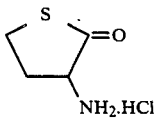

Compound 9

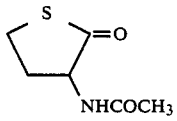

Compound 10

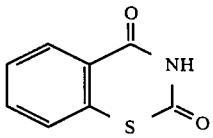

Compound 11

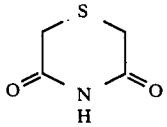

Compound 12

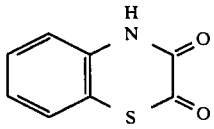

-continued

Compound 13

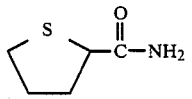

Compound 14

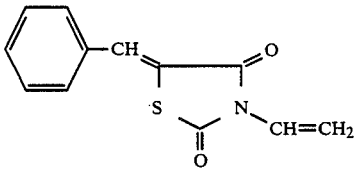

Compound 15

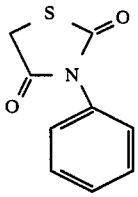

Compound 16

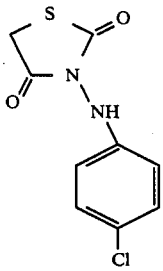

Compound 17

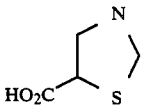

Several preparation examples of these compounds used in accordance with preferred embodiments of the present invention are shown below. Some of the compounds of the present invention are easily commercially available.

PREPARATION EXAMPLE 1

Synthesis of Compound 1

38 g of thiourea and 47.3 g of chloroacetic acid were added to 100 ml of water and refluxed by heating. After one hour, 10 ml of concentrated hydrochloric acid was added and heated under reflux for 4 hours. The reaction mixture was cooled with ice and crude crystals were filtered off. The crude crystals were recrystallized from water to obtain Compound 1. Yield was 42 g (72%).

PREPARATION EXAMPLE 2

Synthesis of Compound 4 22.8 g of thiourea and 37.5 g of ethyl chloroacetate were added to 150 ml of ethanol. In addition, 21.9 g of sodium acetate was added. The resulting mixture was heated under reflux for 1 hour. Then the reaction mixture was allowed to cool, and the crystals thus obtained were filtered off and washed with water to obtain Compound 4. Yield was 25 g (72%).

PREPARATION EXAMPLE 3

Synthesis of Compound 7

76 g of thiourea and 86 g of $\gamma$-butyrolactone were dissolved in 310 ml of 47% hydrogen bromide and heated under reflux for 19 hours. After the reaction mixture was allowed to cool, a solution of 150 g of sodium hydroxide in 200 ml of water was added in small amounts and heated under reflux for 3 hours. Then 110 ml of concentrated sulfuric acid was added in small amounts while cooling with ice. The reaction mixture was extracted with 1,500 ml of ether, and the extract was vacuum-distilled to obtain Compound 7, b.p.: 90°-91° C./23 mmHg. Yield was 39 g (38%).

PREPARATION EXAMPLE 4

Synthesis of Compound 10

14 g of cyanamide prepared by the method described in *Org. Synth. Coll.*, Vo. 4, p. 645 and 30 g of thiosalicylic acid were dissolved in 60 ml of tetrahydrofuran and heated under reflux for 70 minutes. The reaction mixture was cooled to 0° C., and yellow crystals were filtered off. These crystals were dissolved in 30 ml of 6N hydrochloric acid and heated under reflux for 5 hours. The reaction mixture was cooled, and the crystals thus obtained were filtered off and recrystallized from ethanol to obtain Compound 10. Yield was 121.1 g (48%).

The amount of the compound of formula (I) added in the present invention is generally from $2\times10^{-5}$ to $3\times10^{-1}$ mol, and preferably from $2\times10^{-4}$ to $1\times10^{-1}$ mol, per mol of silver halide.

The compound of formula (I) which can be used in the present invention can be added at any desired point before the completion of grain preparation. It is preferred that at least one part of the compound be present from the beginning of grain formation.

The compounds of the present invention can be easily synthesized and are easy in purification and handling. They have a great advantage of being able to provide high silver chloride content tabular grains only by using in combination with a gelatin solution which is peptizer commonly used in the formation of silver halide grains.

Silver halide solvents for use in the preparation of the emulsion of the present invention include thiocyanic acid salts, thioethers, and thioureas. In addition, ammonia can be used in combination within such a range that it does not exert adverse influences.

For example, thiocyanic acid salts (e.g., described in U.S. Pat. Nos. 2,222,264, 2,448,534, and 3,320,069), thioether compounds (e.g., described in U.S. Pat. Nos. 3,271,157, 3,574,628, 3,704,130, 4,297,439, and 4,276,347), thione compounds (e.g., described in Japanese patent application (OPI) Nos. 144319/78, 82408/78, and 77737/80) and amine compounds (e.g., described in Japanese patent application (OPI) No. 100717/79 can be used. The term "OPI" as used herein means an "unexamined published application".

As described in U.S. Pat. Nos. 2,448,060, 2,628,167, 3,737,313, and 3,772,031 and *Research Disclosure*, Vol. 134, RD No. 13452 (June 1975), cadmium salts, zinc salts, lead salts, thallium salts, iridium salts or its complex salts, rhodium salts or its complex salts, iron salts or its complex salts and so on may be allowed to be present in the course of formation or physical ripening of silver halide grains. Particularly preferred are iridium salts and rhodium salts.

In the preparation method of the present invention, a soluble silver salt solution and a soluble halide solution can be added in any desired manner.

That is, each solution may be added at a constant speed, or a method in which to accelerate the grain growth, the speed of addition, the amount and the concentration of the soluble silver salt solution and/or soluble halide solution are increased may be employed.

In accordance with the present invention, the grain formation is performed at a temperature of from 10° to 95° C. and preferably from 40° to 90° C.

The pH is not critical, but is preferably in the neutral to acidic region.

The chloride concentration at the period of nucleus formation is preferably not more than 0.15 mol/l (the term "mol/l" as used herein means "mol per liter of the solution"). The chloride concentration at the period of the growth of grains is from 0.07 to 5.0 mol and preferably from 0.1 to 3.0 mol.

The tabular silver halide grains of the present invention may be used in their primitive form, or may be subjected to chemical sensitization.

Chemical sensitization can be carried out by known techniques such as the gold sensitization method using gold compounds (e.g., described in U.S. Pat. Nos. 2,448,060 and 3,320,069), the sensitization method using metals such as iridium, platium, rhodium, and palladium (e.g., described in U.S. Pat. Nos. 2,448,060, 2,566,245, and 2,566,263), the sulfur sensitization method using sulfur-containing compounds (e.g., described in U.S. Pat. No. 2,222,264), the selenium sensitization method using selenium compounds, the reduction sensitization method using tin salts, thiourea dioxide, polyamine, etc. (e.g., described in U.S. Pat. Nos. 2,487,850, 2,518,698, and 2,521,925), and combinations of two or more thereof.

In the case of tabular silver halide grains of he present invention, the gold sensitization method or the sulfur sensitization method or their combination is preferably used from the standpoint of silver saving.

To the emulsion layer of the silver halide photographic material of the present invention, in addition to tabular silver halide grains, the usual silver halide grains can be added.

Spectral sensitization using methine dyes and so forth can be applied. Dyes which are used for this spectral sensitization include cyanine dyes, merocyanine dyes, composite cyanine dyes, composite merocyanine dyes, holopolar cyanine dyes, hemicyanine dyes, styryl dyes, and hemioxonol dyes. Particularly useful dyes are cyanine dyes, merócyanine dyes, and composite merocyanine dyes.

In these dyes, any of nuclei commonly used in cyanine dyes as basic heterocyclic nuclei can be utilized, such as a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, and the like; nuclei resulting from the fusion of alicyclic hydrocarbon rings to the above nuclei; and nuclei resulting from the fusion of aromatic hydrocarbon rings to the above nuclei, i.e., an indolenine nucleus, a benzindolenine nucleus, an indole nucleus, a benzoxazole nucleus, a naphthoxazole nucleus, a benzthiazole nucleus, a naphthothiazole nucleus, a benzoselenazole nucleus, a benzimidazole nucleus, a quinoline nucleus, and so forth can be utilized. These nuclei may be substituted at the carbon atom.

To the merocyanine dye or composite merocyanine dye, as nuclei having the ketomethylene structure, 5- or 6-membered heterocyclic nuclei such as a pyrazoline-5-one nucleus, a thiohydantoin nucleus, a 2-thiooxazolidine-2,4-dione nucleus, a thiazolidine-2,4-dione nucleus, a rhodamine nucleus and a thiobarbituric acid nucleus can be applied.

For example, the compounds described in *Research Disclosure,* RD No. 17643, Vol. IV, p. 23 (December 1978), and in the reference cited in the *Research Disclosure* can be used.

Representative examples are methine dyes represented by formula (Ia), (IIa), and (IIIa) described below,

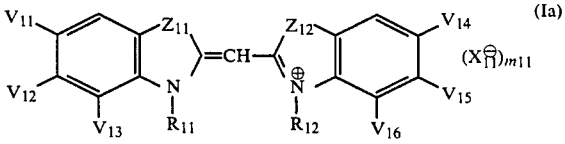

In formula (Ia), $Z_{11}$ is an oxygen atom, a sulfur atom, or a selenium atom, and $Z_{12}$ is a sulfur atom or a selenium atom.

$R_{11}$ and $R_{12}$ are substituted or unsubstituted alkyl or alkenyl groups having not more than 6 carbon atoms. One of $R_{11}$ and $R_{12}$ is a sulfo substituted alkyl group, particularly preferably a 3-sulfopropyl group, a 2-hydroxy-3-sulfopropyl group, a 3-sulfobutyl group, or a sulfoethyl group. Examples of the substituents are an alkoxy group having not more than 4 carbon atoms, a halogen atom, a hydroxyl group, a carbamoyl group, a substituted or unsubstituted phenyl group having not more than 8 carbon atoms, a carboxyl group, a sulfo group and an alkoxycarbonyl group having not more than 5 carbon atoms.

Representative examples of the groups represented by $R_{11}$ and $R_{12}$ are a methyl group, an ethyl group, a propyl group, an allyl group, a pentyl group, a hexyl group, a methoxyethyl group, an ethoxyethyl group, a phenetyl group, a 2-p-tolylethyl group, a 2-p-sulfophenetyl group, a 2,2,2-trifluoroethyl group, a 2,2,3,3,-tetrafluoropropyl group, a carbamoylethyl group, a hydroxyethyl group, a 2-(2-hydroxyethyl)ethyl group, a carboxymethyl group, a carboxyethyl group, an ethoxycarbonylmethyl group, a 2-sulfoethyl group, a 2-chloro-3-sulfopropyl group, a 3-sulfopropyl group, a 2-hydroxy-3-sulfopropyl group, a 3-sulfobutyl group, and a 4-sulfobutyl group.

When $Z_{11}$ is an oxygen atom, $V_{11}$ and $V_{13}$ are each a hydrogen atom and $V_{12}$ is a phenyl group, an alkyl group having not more than 3 carbon atoms, an alkoxyl group having not more than 3 carbon atoms, or a phenyl group substituted by a chlorine atom (particularly preferably a phenyl group). $V_{11}$ and $V_{12}$ or $V_{12}$ and $V_{13}$ may be linked to each other to form a condensed benzene ring. It is particularly preferred that $V_{11}$ and $V_{13}$ are hydrogen atoms and $V_{12}$ is a phenyl group.

When $Z_{11}$ is a sulfur atom or a selenium atom, $V_{11}$ is an alkyl group having not more than 4 carbon atoms, an alkoxy group having not more than 4 carbon atoms, or a hydrogen atom, $V_{12}$ is an alkyl group having not more than 5 carbon atoms, an alkoxy group having not more than 4 carbon atoms, a chlorine atom, a hydrogen atom, a substituted or unsubstituted phenyl group (e.g., a tolyl group, an anisyl group, and a phenyl group), or a hydroxyl group, and $V_{13}$ is a hydrogen atom. $V_{11}$ and $V_{12}$ or $V_{12}$ and $V_{13}$ may be linked to each other to form a condensed benzene ring. It is more preferred that $V_{11}$ and $V_{13}$ are each a hydrogen atom and $V_{12}$ is an alkoxy group having not more than 4 carbon atoms, a phenyl group, or a chlorine atom, $V_{11}$ is an alkoxy or alkyl group having not more than 4 carbon atoms, $V_{13}$ is a hydrogen atom, and $V_{12}$ is a hydroxyl or alkyl group having not more than 4 carbon atoms, or $V_{11}$ is a hydrogen atom, and $V_{12}$ and $V_{13}$ are linked to each other to form a condensed benzene ring.

When $Z_{12}$ is a selenium atom, $V_{14}$, $V_{15}$, and $V_{16}$ are respectively the same as $V_{11}$, $V_{12}$, and $V_{13}$ when $Z_{11}$ is a selenium atom.

When $Z_{12}$ is a sulfur atom and further $Z_{11}$ is a selenium atom, $V_{14}$ is a hydrogen atom, an alkoxy group having not more than 4 carbon atoms or an alkyl group having not more than 5 carbon atoms, and $V_{15}$ is an alkoxy group having not more than 4 carbon atoms, a substituted or unsubstituted phenyl group (e.g., a phenyl group, a tolyl group, and an anisyl group, preferably a phenyl group), an alkyl group having not more than 4 carbon atoms, a chlorine atom, or a hydroxyl group, and $V_{16}$ is a hydrogen atom. $V_{14}$ and $V_{15}$ or $V_{15}$ and $V_{16}$ may be linked to each other to form a condensed benzene ring. It is more preferred that $V_{14}$ and $V_{16}$ are each a hydrogen atom, and $V_{15}$ is an alkoxy group having not more than 4 carbon atoms, a chlorine atom, or a phenyl group, or $V_{14}$ is a hydrogen atom, and $V_{15}$ and $V_{16}$ may be linked to each other to form a condensed benzene ring.

When $Z_{11}$ and $Z_{12}$ *are both sulfur atoms,* $V_{14}$ and $V_{16}$ are hydrogen atoms, $V_{15}$ is a substituted or unsubstituted phenyl group (e.g., a phenyl group and a tolyl group), or $V_{14}$ is a hydrogen atom and $V_{15}$ and $V_{16}$ may be linked to each other to form a condensed benzene ring.

When $Z_{11}$ is an oxygen atom and $Z_{12}$ is a sulfur atom, $V_{14}$ and $V_{16}$ are hydrogen atoms, $V_{15}$ is a chlorine atom, a substituted or unsubstituted phenyl group or an alkoxy group having not more than 4 carbon atoms. $V_{15}$ and $V_{16}$ may be linked to each other to form a condensed benzene ring. It is more preferred that $V_{14}$ and $V_{16}$ are each a hydrogen atom and $V_{15}$ is a phenyl group, or $V_{14}$ is a hydrogen atom and $V_{15}$ and $V_{16}$ are linked to each other to form a condensed benzene ring.

$X_{11}^{\ominus}$ is an acid anion radical.

$m_{11}$ is 0 or 1, and in the case of an intramolecular salt, is 1.

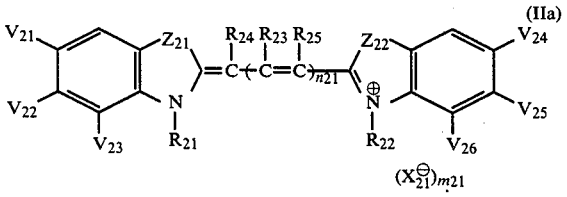

In formula (IIa), $Z_{21}$ and $Z_{22}$ (which may be the same or different), and are each an oxygen atom, a sulfur atom, a selenium atom, or N-$R_{26}$.

$R_{21}$ and $R_{22}$ are the same as $R_{11}$ and $R_{12}$, respectively, in formula (Ia). $R_{21}$ and $R_{24}$ may be linked to each other to form a 5- or 6-membered carbon ring, and $R_{22}$ and $R_{25}$ may be linked to each other to form a 5- or 6-membered carbon ring. When $n_{21}$ is 2 or 3, $R_{21}$ and $R_{22}$ cannot be sulfo group-having substituents at the same time.

When at least one of $Z_{21}$ and $Z_{22}$ is N-$R_{26}$, $R_{23}$ is a hydrogen atom. When neither $Z_{21}$ nor $Z_{22}$ is N-$R_{26}$, $R_{23}$ is a lower alkyl group or a phenetyl group (more preferably an ethyl group). When $n_{21}$ is 2 or 3, different $R_{23}$ groups may be linked to each other to form a 5- or 6-membered ring.

$R_{24}$ and $R_{25}$ are each a hydrogen atom.

$R_{26}$ and $R_{27}$ are the same as $R_{21}$ and $R_{22}$, respectively. $R_{21}$ and $R_{26}$ cannot be sulfo group-having substituents at the same time, and $R_{22}$ and $R_{26}$ cannot be also sulfo group-having substituents at the same time.

When $Z_{21}$ is an oxygen atom, $V_{21}$ is a hydrogen atom. When $Z_{21}$ is a sulfur atom or a selenium atom, $V_{21}$ is a hydrogen atom, an alkyl group having no more than 5 carbon atoms, or an alkoxy group having not more than 5 carbon atoms. When $Z_{21}$ is N-$R_{26}$, $V_{21}$ is a hydrogen atom or a chlorine atom.

When $Z_{21}$ is an oxygen atom and $Z_{22}$ is N-$R_{27}$, $V_{22}$ is a hydrogen atom, an alkyl group having not more than 5 carbon atoms, an alkoxy group having not more than 5 carbon atoms, a chlorine atom or a substituted or unsubstituted phenyl group (e.g., a tolyl group, an anisyl group, and a phenyl group). $V_{22}$ may be linked to $V_{21}$ or $V_{23}$ to form a condensed benzene ring (more preferably $V_{22}$ is an alkoxy group or a phenyl group, or $V_{21}$ and $V_{22}$ or $V_{22}$ and $V_{23}$ are linked to each other to form a condensed benzene ring).

When $Z_{21}$ and $Z_{22}$ are both oxygen atoms, $V_{22}$ is a substituted or unsubstituted phenyl group (e.g., a tolyl group, an anisyl group and a phenyl group, preferably a phenyl group), or may be linked to $V_{21}$ to $V_{23}$ to form a condensed benzene ring.

When $Z_{21}$ is a sulfur atom or a selenium atom, $V_{22}$ is a hydrogen atom, an alkyl group having not more than 5 carbon atoms, an alkoxycarbonyl group having not more than 5 carbon atoms, an alkoxy group having not more than 5 carbon atoms, an acylamino group having not more than 4 carbon atoms, a chlorine atom or a substituted or unsubstituted phenyl group (more preferably an alkyl group having not more than 4 carbon atoms, an alkoxy group having not more than 4 carbon atoms, a chlorine atom, or a phenyl group). $V_{22}$ may be linked to $V_{23}$ to form a condensed benzene ring. When $Z_{21}$ is N-$R_{26}$, $V_{22}$ is a chlorine atom, a trifluoromethyl group, a cyano group, an alkylsulfonyl group having not more than 4 carbon atoms or an alkoxycarbonyl group having not more than 5 carbon atoms (when $Z_{21}$ is N-$R_{26}$, it is more preferred than $V_{21}$ is a chlorine atom, $V_{22}$ is a chlorine atom, a trifluoromethyl group, or a cyano group).

$V_{24}$ is the same atoms as for $V_{21}$ listed in the case when $Z_{22}$ and $Z_{21}$ each is the above-defined atoms.

When $Z_{22}$ is an oxygen atom, $V_{25}$ is an alkoxy group having not more than 5 carbon atoms, a chlorine atom, or a substituted or unsubstituted phenyl group (e.g., an anisyl group, a tolyl group, and a phenyl group), or alternatively $V_{25}$ may be linked to $V_{24}$ or $V_{26}$ to form a condensed benzene ring. It is more preferred that when $Z_{21}$ is N-$R_{26}$, $V_{25}$ is an alkoxy group having not more than 5 carbon atoms or a phenyl group, or alternatively is linked to $V_{24}$ or $V_{26}$ to form a condensed benzene ring; when $Z_{21}$ is an oxygen atom, a sulfur atom or a selenium atom, $V_{25}$ is preferably a phenyl group or alternatively is linked to $V_{24}$ or $V_{26}$ to form a condensed benzene ring. $V_{25}$ when $Z_{22}$ is N-$R_{26}$ is the same as $V_{22}$ when $Z_{21}$ is N-$R_{26}$, and $V_{25}$ when $Z_{22}$ is a sulfur atom or a selenium atom is the same as $V_{22}$ when $Z_{21}$ is a sulfur atom or a selenium atom.

$V_{26}$ is a hydrogen atom.

$X_{21}^{\ominus}$ is an acid anion radical.

$m_{21}$ is 0 or 1, and in the case of an intramolecular salt, is 0.

$n_{21}$ is 1, 2, or 3, preferably 1 or 2, and more preferably 1.

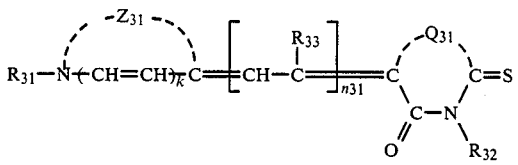

(IIIa)

In formula (IIIa), $Z_{31}$ is an atomic group to form a heterocyclic nucleus, such as thiazoline, thiazole, benzothiazole, naphthothiazole, selenazoline, selenazole, benzoselenazole, naphthoselenazole, benzimidazole, naphthoimidazole, oxazole, benzoxazole, naphthooxazole, and pyridine, which may be substituted. When $Z_{31}$ forms a benzimidazole nucleus or a naphthoimidazole nucleus, the substituent of the nitrogen atom at the 1-position, but not $R_{31}$ includes those listed for $R_{26}$ or $R_{27}$ in formula (IIa). The substituent of the condensed benzene ring of benzimidazole includes a chlorine atom, a cyano group, an alkoxycarbonyl group having not more than 5 carbon atoms, an alkylsulfonyl group having not more than 4 carbon atoms, and a trifluoromethyl group. Particularly preferably it is substituted by a chlorine atom at the 5-position, and by a cyano group, a chlorine atom, or a trifluoromethyl group at the 6-position. In the case of heterocyclic nuclei other than benzimidazole, selenazoline and thiazoline nuclei, the substituent includes a substituted or unsubstituted alkyl group having a total number of carbon atoms of not more than 8 (in the case of the substituted alkyl group, the substituent includes a hydroxyl group, a chlorine atom, a fluorine atom, an alkoxy group, a carboxyl group, an alkoxycarbonyl group, a phenyl group, and a substituted phenyl group), a hydroxyl group, an alkoxycarbonyl group having not more than 5 carbon atoms, a halogen atom, a carboxyl group, a furyl group, a thienyl group, a pyridyl group, a phenyl group and a substituted phenyl group (e.g., a tolyl group, an anisyl group, and a chlorophenyl group). In the case of selenazoline or thiazoline nucleus, the substituent includes an alkyl group having not more than 6 carbon atoms, a hydroxyalkyl group having not more than 5 carbon atom and an alkoxycarbonylalkyl group having not more than 5 carbon atoms.

$R_{31}$ is the same as $R_{11}$ or $R_{12}$ in formula (Ia).

$R_{32}$ is the same as $R_{11}$ or $R_{12}$ in formula (Ia) and further represents a hydrogen atom, a furfuryl group, or a substituted or unsubstituted monocyclic aryl group (e.g., a phenyl group, a tolyl group, an anisyl group, a carboxyphenyl group, a hydroxyphenyl group, a chlorophenyl group, a sulfophenyl group, a pyridyl group, a 5-methyl-2-pyridyl group, a 5-chloro-2-pyridyl group, a thienyl group, or a furyl group). At least one of $R_{31}$ and $R_{32}$ is a sulfo group-having substituent or a carboxyl group-having substituent, and the other is a substituent not having a sulfo group.

$R_{33}$ is a hydrogen atom, an alkyl group having not more than 5 carbon atoms, a phenetyl group, a phenyl group, or a 2-carboxyphenyl group. When n is 2 or 3, different $R_{33}$ groups my be linked to each other to form a 5- or 6-membered ring.

$Q_{31}$ is an oxygen atom, a sulfur atom, a selenium atom or N-$R_{34}$. When $Z_{31}$ is an atomic group forming a thiazoline, selenazoline, or oxazole nucleus, $Q_{31}$ is preferably a sulfur atom, a selenium atom, or N-$R_{34}$.

$R_{34}$ is a hydrogen atom, a pyridyl group, an unsubstituted phenyl group, a substituted phenyl group (e.g., a tolyl group and an anisyl group), or an aliphatic hydrocarbon group having not more than 8 carbon atoms which may contain an oxygena atom, a sulfur atom, or a nitrogen atom in the carbon chain thereof and may be substituted by groups such as a hydroxy group, a halogen atom, an alkylaminocarbonyl group, an alkoxycarbonyl group, and a phenyl group. More preferably $R_{34}$ is a hydrogen atom, a phenyl group, a pyridyl group, or an alkyl group which may contain an oxygen atom in the carbon chain thereof and may be substituted by a hydroxyl group.

k is 0 or 1.

$n_{31}$ is 0, 1, 2, or 3, preferably 0, 1, or 2, and more preferably 0 or 1.

Spectral sensitizing dyes which are preferably used in the present invention are shown below.

II-1

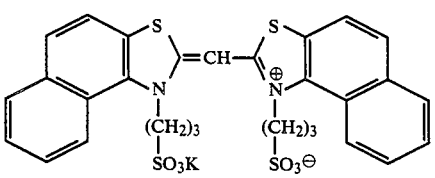

II-2

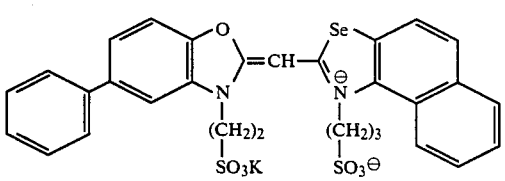

II-3

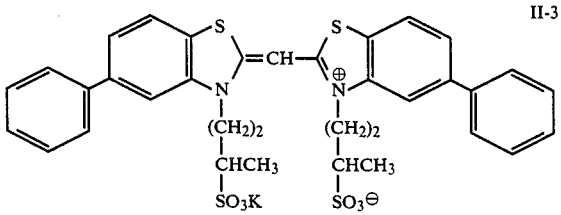

II-4

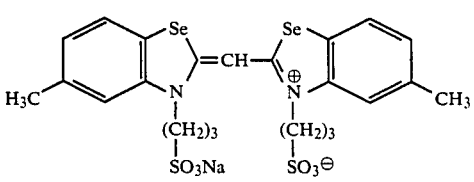

II-5

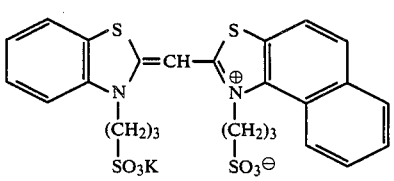

II-6

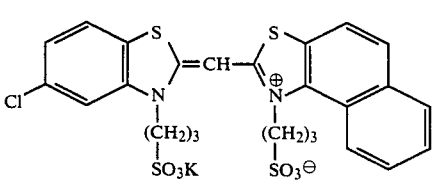

-continued
II-7
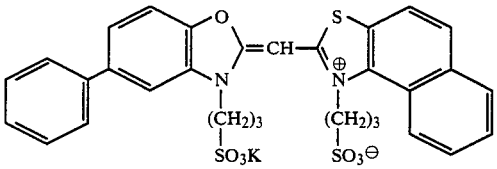
II-8
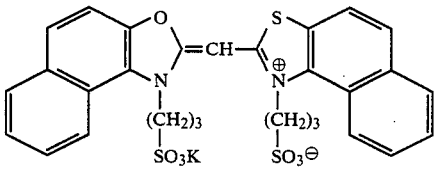
II-9
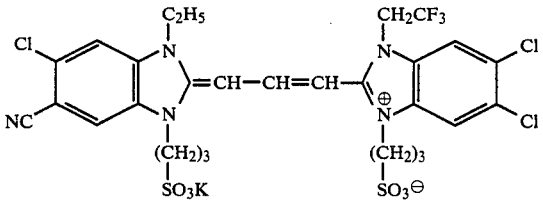
II-10
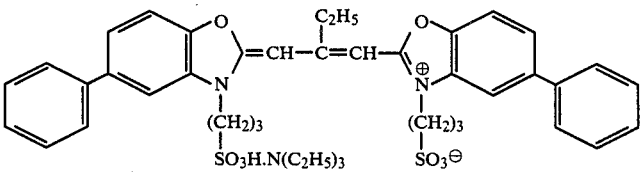
II-11
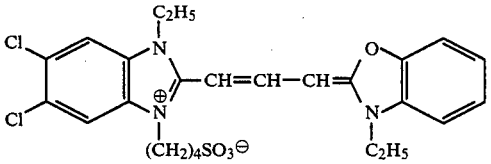
II-12
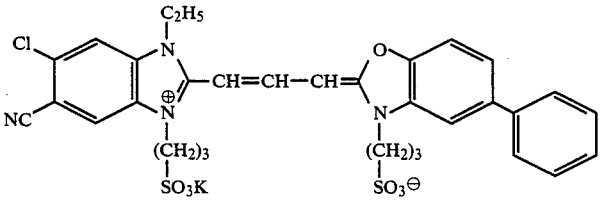
II-13
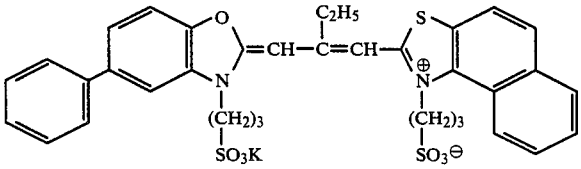
II-14
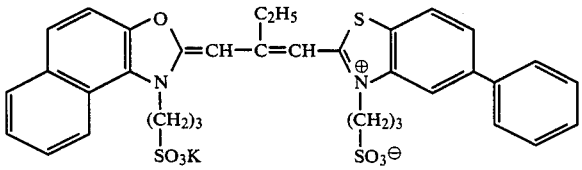
II-15
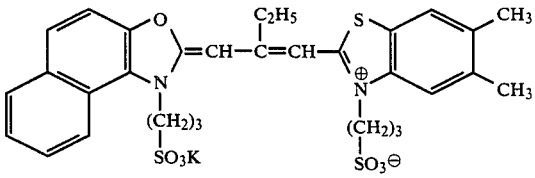

-continued
II-16
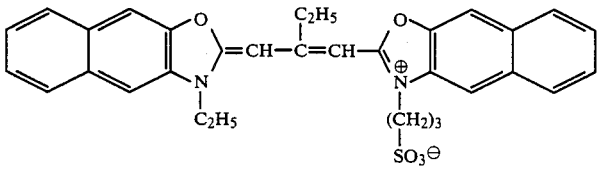
II-17
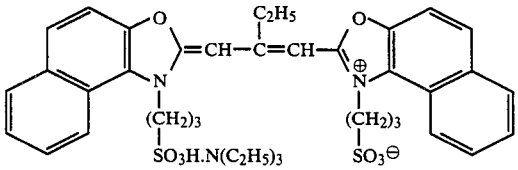
II-18
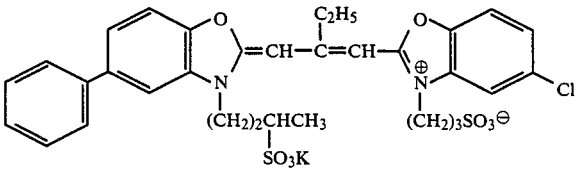
II-19
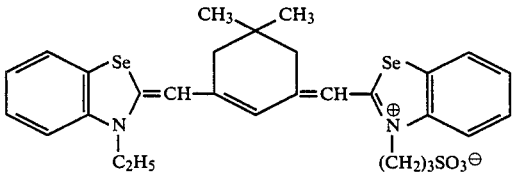
II-20
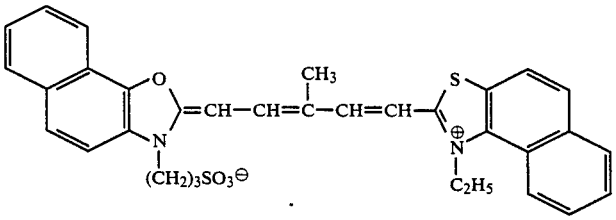
II-21
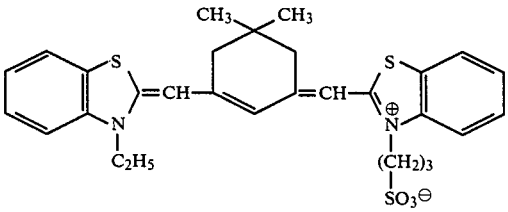
II-22
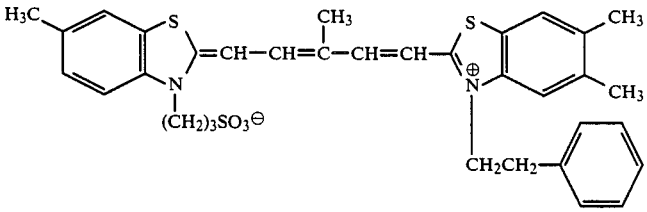

-continued
II-23
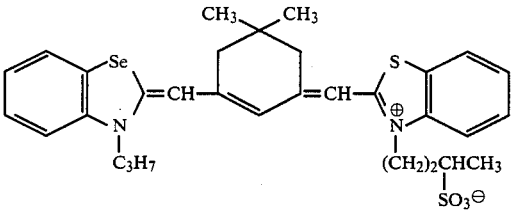
II-24
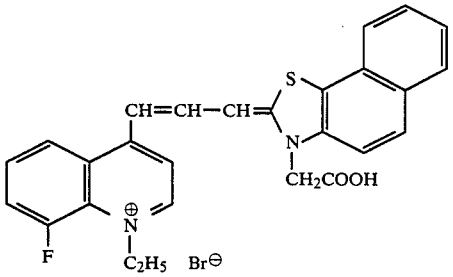
II-25
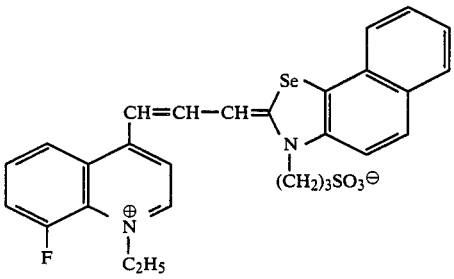
II-26
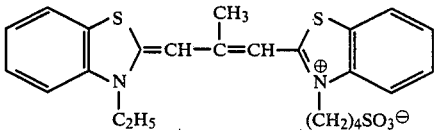
II-27
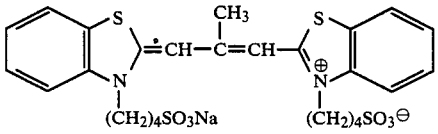
II-28
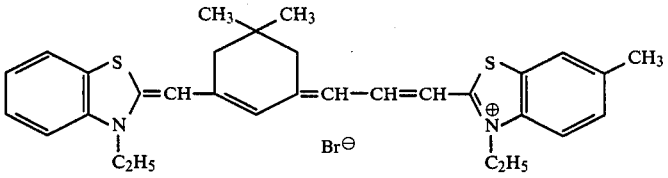
II-29
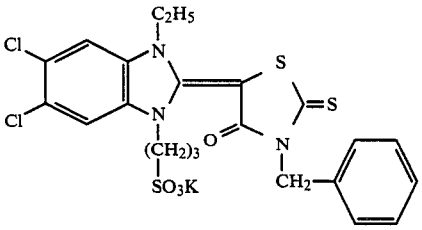
II-30
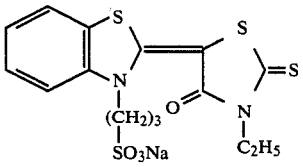
II-31
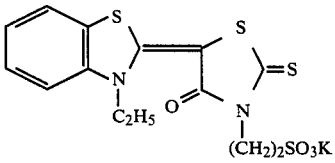
II-32
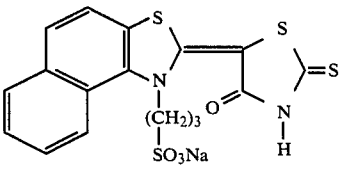
II-33
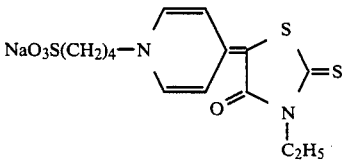
II-34
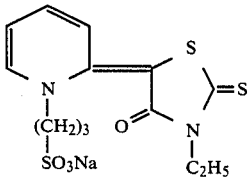

-continued

II-35

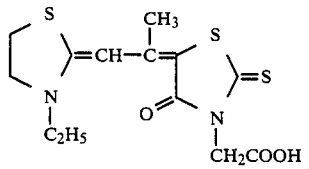

II-36

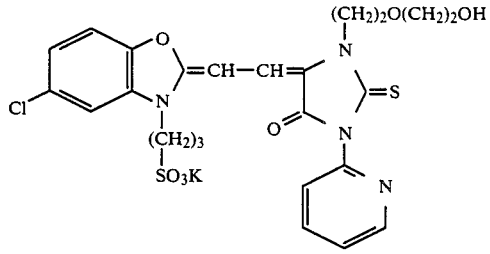

II-37

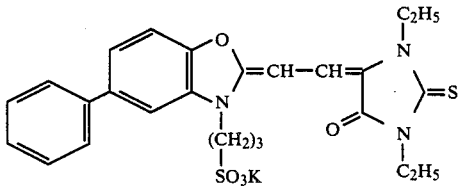

II-38

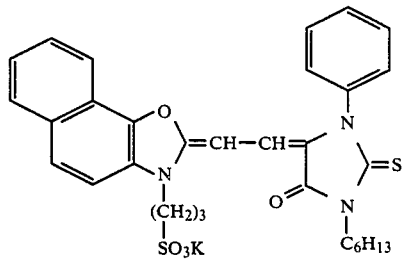

II-39

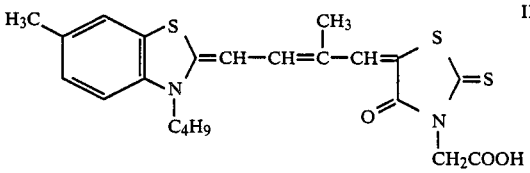

II-40

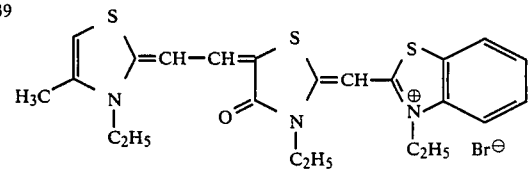

II-41

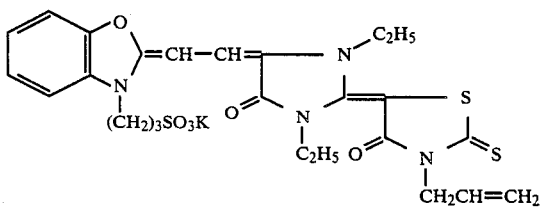

The dye can be added to the emulsion at any desired point known to be useful in the preparation of silver halide emulsions. Most commonly, the dye is added to the emulsion during the period of from the completion of chemical sensitization to the coating. In addition, spectral sensitization can be carried out simultaneously with chemical sensitization as described in U.S. Pat. Nos. 3,628,969 and 4,225,666 by adding a dye concurrently with a chemical sensitizer; spectral sensitization can be carried out prior to chemical sensitization as described in Japanese patent application (OPI) No. 113928/83; or spectral sensitization can be started by adding a dye prior to the completion of formation of silver halide grain precipitation. Furthermore, as described in U.S. Pat. No. 4,225,666, the dye can be added in several portions; that is, a part of the dye is added prior to chemical sensitization and the remainder is added after chemical sensitization. Moreover, the method disclosed in U.S. Pat. No. 4,183,756 can be employed.

The amount of the compound added is from $4\times10^{-6}$ to $8\times10^{-3}$ mol per mol of silver halide. When the silver halide grain size is from 0.2 to 1.2 $\mu$m, the amount of the compound added is preferably about from $5\times10^{-5}$ to $2\times10^{-3}$ mol per mol of silver halide.

The silver halide emulsion of the present invention can be used in both of a color photographic material and a black-and-white photographic material.

The color photographic material includes a color paper, a color film for cameras, a color reversal film, and so forth. The black-and-white photographic material includes an X-ray film, a general film for cameras, a film for printing light-sensitive material, and so forth. This is preferably used particularly as a color paper.

In connection with additives for the photographic material to which the emulsion of the present invention is to be applied, reference can be made to *Research Disclosure,* RD No. 17643 (December 1978) and Ibid., RD No. 18716 (November 1979).

Pages and lines of RD 17643 and RD 18716 at which the additives are described are listed in the table below.

| Kind of Additives | Research Disclosure No. 17643 | Research Disclosure No. 18716 |
|---|---|---|
| 1. Chemical Sensitizers | p. 23 | p. 648, right column |
| 2. Sensitivity Increasing Agents | — | p. 648, right column |
| 3. Spectral Sensitizers and Supersensitizers | pp. 23–24 | p. 648, right column to p. 649, right column |
| 4. Brightening Agents | p. 24 | — |
| 5. Antifoggants and Stabilizers | pp. 24–25 | p. 649, right column |
| 6. Light-Absorbers, Filter Dyes and | pp. 25–26 | p. 649, right column to p. 650, |

-continued

| Kind of Additives | Research Disclosure No. 17643 | Research Disclosure No. 18716 |
|---|---|---|
| Ultraviolet Light Absorbents | | left column |
| 7. Antistaining Agents | p. 25, right column | p. 650, left column to right column |
| 8. Dye Image Stabilizers | p. 25 | — |
| 9. Hardeners | p. 26 | p. 651, left column |
| 10. Binders | p. 26 | p. 651, left column |
| 11. Plasticizers and Lubricants | p. 27 | p. 650, right column |
| 12. Coating Aids and Surfactants | pp. 26–27 | p. 650, right column |
| 13. Antistatic Agents | p. 27 | p. 650, right column |

Compounds which are preferably used as antifoggants or stabilizers among the above additive include azoles (e.g., benzothiazolium salts, nitriomidazoles, nitrobenzimidazoles, chlorobenzimidazoles, bromobenzimidazoles, nitroindazoles, benzotriazoles, and aminotriazoles); mercapto compounds (e.g., mercaptothiazoles, mercaptobenzothiazoles, mercaptobenzimidazoles, mercaptothiadiazoles, mercaptotetrazoles (particularly 1-phenyl-5-mercaptotetrazole), mercaptopyrimidines, and mercaptotriazines); thioketo compounds such as oxadolinthiones; azaindenes (e.g., triazaindenes, tetraazaindenes (particularly 4-hydroxy substituted (1,3,3a,7)tetraazaindenes), and pentaazaindenes); benzenethiosulfonic acid, benzenesulfinic acid, and benzenesulfonic acid amide.

As color couplers, non-diffusing couplers having a hydrophobic group (referred to as a ballast group) in the molecule thereof or polymerized couplers are desirable. The coupler may be 4-equivalent or 2-equivalent relative to silver ion. A colored coupler having the effect of color correction, or a coupler releasing a development inhibitor with the advance of development (a so-called DIR coupler) may be contained. In addition, a colorless DIR coupling compound producing a colorless coupling reaction product and releasing a development inhibitor may be contained.

For example, the magenta coupler includes a 5-pyrazolone coupler, a pyrazolobenzimidazole coupler, a pyrazolotriazole coupler, a pyrazolotetrazole coupler, a cyanoacetylcoumarone coupler, and an open-chain acylacetonitrile coupler. The yellow coupler includes an acylacetoamide coupler (e.g., benzoylacetoanilides and pivaloylacetoanilides). Cyan couplers include naphtholic couplers and phenolic couplers. As the cyan coupler, a phenol-based coupler having an ethyl group in the meta-position of the phenol nucleus, 2,5-diacylamino substituted phenol-based coupler, a phenol-based coupler having a phenylureido group in the 2-position and an acylamino group in the 5-position, a naphthol-based coupler substituted by sulfonamide, amide or the like in the 5-position thereof, and so forth as described in U.S. Pat. Nos. 3,772,002, 2,772,162, 3,758,308, 4,126,396, 4,334,011, 4,327,173, 3,446,622, 4,333,999, 4,451,559, and 4,427,767 are preferably used in that an image having excellent fastness is obtained.

In order to satisfy the requirements for the light-sensitive material, two or more of the above couplers can be added to the same layer, or the same compound can be added to two or more different layers.

Typical examples of the anti-fading agent include hydroquinones, 6-hydroxycoumarones, 5-hydroxycoumaranes, spirochromans, p-alkoxyphenols, hindered phenols such as bisphenols, gallic acid derivatives, methylenedioxybenzenes, aminophenols, hindered amines, and ether or ester derivatives resulting from silylating or alkylating of the phenolic hydroxyl group of the above compounds. In addition, metal complex compounds exemplified by a (bissalicylaldoximate) nickel complex and a (bis-N,N-dialkyldithiocarbamate) nickel complex can be used.

The light-sensitive material using the emulsion of the present invention can be processed by known techniques. In this photographic processing, known processing solutions can be used. The processing temperature is usually chosen from the range of from 18° to 50° C. Temperatures higher than 50° C. or lower than 18° C. can also be employed. Depending on the purpose, a developing processing forming a silver image (black-and-white photographic processing) or a color photographic processing comprising a developing processing to form a dye image can be applied.

In the black-and-white developer, known developing agent such as dihydroxybenzenes (e.g., hydroquinone), 3-pyrazolidones (e.g., 1-phenyl-3-pyrazolidone), and aminophenols (e.g., N-methyl-p-aminophenol) can be used alone or in combination with each other.

A color developer is generally an alkaline aqueous solution containing a color developing agent. As color developing agents, known primary aromatic amine developers such as phenylenediamines (e.g., 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline 3-methyl-4-amino-N-ethyl-N-$\beta$-methanesulfoamidoethylaniline, and 4-amino-3-methyl-N-ethyl-N-$\beta$-methoxyethylaniline) can be used.

In addition, compounds as described in L. F. A. Mason, *Photographic Processing Chemistry,* The Focal Press (1966), pp. 226–229, U.S. Pat. Nos. 2,193,015 and 2,592,364, and Japanese patent application (OPI) No. 64933/73 can be used.

In addition, the developer can contain a pH buffer such as the sulfurous acid salts, carbonic acid salts, boric acid salts, or phosphoric acid salts of alkali metals, a development inhibitor such as bromides, iodides, and organic antifoggants, an antifoggant and so forth. If necessary, the developer may contain a hard water-softening agent, a preservaive such as hydroxylamine, an organic solvent such as benzyl alcohol and diethylene glycol, a development accelerator such as polyethylene glycol, quaternary ammonium salts and amines, a dye-forming coupler, a competitive coupler, a fogging agent such as sodiumboron hydride, an auxiliary developing agent such as 1-phenyl-3-pyrazolidone, a tackifier, a polycarboxylic acid-based chelating agent as described in U.S. Pat. No. 4,083,723, an antioxidant as described in West German patent application (OLS) No. 2,622,950, and so forth.

When color photographic processing is applied, the color developed light-sensitive material is usually bleached. This bleach processing may be carried out simultaneously with a fix processing, or they may be carried out independently. Bleaching agents which can be used include the compounds of polyvalent metals such as iron (III), cobalt (III), chromium (VI), and copper (II), peracids, quinones, and nitroso compounds. For example, ferricyanides, dichromic acid salts, organic complex salts of iron (III) or cobalt (III), complex salts of organic acids such as aminopolycarboxylic acids (e.g., ethylenediaminetetraacetic acid, nitrotriacetic acid, and 1,3-diamino-2-propanol-tetraacetic acid), citric acid, tartaric acid, and malic acid, persulfuric acid salts, permanganic acid salts, nitrosophenol and so forth can be used. Of these compounds, potassium ferricyanide, iron (III) sodium ethylenediaminetetraacetate, and iron (III) ammonium ethylenediaminetetraacetate are particularly useful. The ethylenediaminetetraacetic acid iron (III) complex salt is useful both in an independent bleaching solution and in a monobath bleach-fixing solution.

To the bleaching or bleach-fixing solution can be added bleach accelerators as described in U.S. Pat. Nos. 3,042,520 and 3,241,966, Japanese patent publication Nos. 8506/70 and 8836/70, a thiol compound as described in Japanese patent application (OPI) No. 65732/78, and other various additives. After the bleaching or bleach-fixing processing, water-washing may be applied, or only a stabilizing bath processing may be applied.

The present invention is described in greater detail with reference to the following examples, although it is not intended to be limited thereto.

EXAMPLE 1

| Preparation of emulsion | |
|---|---|
| Solution (1) | |
| Bone gelatin | 30 g |
| NaCl | 5 g |
| $H_2O$ | 1,000 ml |
| $NH_4NO_3$ | 3 g |
| Solution (2) | |
| $AgNO_3$ | 20 g |
| $NH_4NO_3$ | 0.5 g |
| Water to make | 300 ml |
| Solution (3) | |
| NaCl | 9.9 g |
| Water to make | 300 ml |
| Solution (4) | |
| $AgNO_3$ | 80 g |
| $NH_4NO_3$ | 1 g |
| Water to make | 600 ml |
| Solution (5) | |
| NaCl | 40.8 g |
| Water to make | 600 ml |

The solution (1) was maintained at 70° C. and adjusted to pH 5.0 by adding 1N sulfuric acid. Then the solutions (2) and (3) were added at the same time to the solution (1) over 5 minutes while vigorously stirring the solution (1).

Then the solutions (4) and (5) were added at the same time over 20 minutes at such a speed that the final flow rate was 3 times the initial flow rate, to obtain a silver chloride emulsion (A). The emulsion (A) was composed of monodisperse cubic grains having an average volume of 0.30 $\mu m^3$.

The amount of NaCl in the solution (1) was changed to 14 g and the solution (1) was adjusted to pH 5.0 by adding 1 g of the compound 1 represented by formula (I). The temperature of the solution (1) was adjusted to 55° C., and the solutions (2) and (3) were added at the same time over 5 minutes while vigorously stirring the solution (1). Then the solutions (4) and (5) were added at the same time over 30 minutes at such a speed that the final flow rate was twice the initial flow rate, to obtain a silver chloride emulsion (B). In the emulsion (B), grains were tabular, the average volume weighted by volume was 0.25 $\mu m^3$, tabular grains having an aspect ratio of from 2 to 10 were about 90% of the total projected area, and the average aspect ratio of tabular grains having an aspect ratio of not less than 2 was about 7.

The amount of NaCl in the solution (1) was changed to 25 g, and 3 g of the compound (1) was added. The solutions (2) and (3) were added at the same time over 3 minutes while maintaining the temperature of the solution (1) at 50° C. and vigorously stirring the solution (1). Then the solutions (4) and (5) were slowly added at the same time over 60 minutes to obtain a silver chloride emulsion (C). The emulsion (C) was composed of thin tabular grains, and the average volume weighted by volume was 0.35 $\mu m^3$. The aspect ratio of tabular grains having an aspect ratio of not less than 2 was 13. Tabular grains having an aspect ratio of from 2 to 10 were not more than about 25% of the total projected area.

After washing with water and de-salting by the usual flocculation method, gelatin was added, and the pH and pAg were adjusted to 6.4 to 7.5, respectively, at 40° C.

The emulsions were subjected to chemical sensitization using diphenylthiourea to obtain the following samples 1 to 3.

To a triacetyl cellulose film support having a subbing layer were coated the additives for the emulsion layer and the protective layer shown below to obtain the light-sensitive materials.

(1) Emulsion layer

Emulsion: Emulsion shown in Table 1

Coupler:

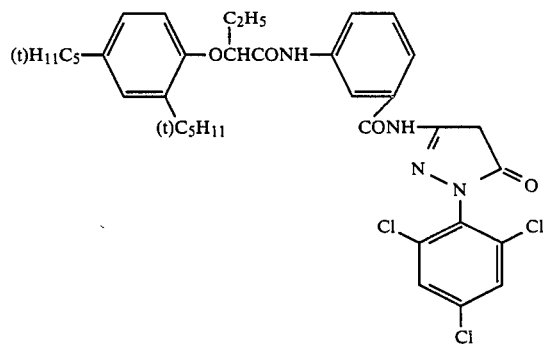

Sensitizing dye: 5,5'-diphenyl-9-ethyl-3,3'-di(3-sulfopropyl)oxacarbocyanine sodium salt Stabilizer: 4-hydroxy-6-methyl-1,3,3a,7-tetraazaindene Coating aid: sodium dodecylbenzenesulfonate Tricresyl phosphate Gelatin (2) Protective layer 2,4-Dichlorotriazine-6-hydroxy-s-triazine sodium salt Gelatin Each sample was exposed through a yellow filter to light for sensitometry and color developed.

The above developed sample was measured for density by the use of a green filter. Photographic properties of the samples are shown in Table 1.

The above color development was carried out at 38° C. under the following conditions.

1. Color development

-continued

| | |
|---|---|
| 2. Bleaching | 6.5 minutes |
| 3. Washing with water | 3.25 minutes |
| 4. Fixing | 6.5 minutes |
| 5. Washing with water | 3.25 minutes |
| 6. Stabilization | 3.25 minutes |

The formulation of the processing solution at each step was as follows.

| | |
|---|---|
| Color developer | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N—ethyl-N—β-hydroxyethyl-amino)-2-methyl-aniline sulfate | 4.5 g |
| Water to make | 1,000 ml |
| Bleaching solution | |
| Ammonium bromide | 160.0 g |
| Ammonia water (28 wt %) | 25.0 ml |
| Ethylenediaminetetraacetic acid sodium salt | 130 g |
| Glacial acetic acid | 14 ml |
| Water to make | 1,000 ml |
| Fixing solution | |
| Sodium tetrapolyphosphate | 2.0 g |
| Sodium sulfite | 4.0 g |
| Ammonium thiosulfate (70 wt %) | 175.0 ml |
| Sodium disulfite | 4.6 g |
| Water to make | 1,000 ml |
| Stabilizing solution | |
| Formalin (37 wt % of formaldehyde solution) | 8.0 ml |
| Water to make | 1,000 ml |

The above processed samples were each measured for density as described in U.S. Pat. No. 4,614,711. The results are shown in Table 1 below. The sensitivity indicates a reciprocal value of an exposure amount necessary to provide an optical density of fog +1.0 and is indicated with respect to that at 3'15" (3 min and 15 sec) of sample 1 being taken as 100. The fog value indicates the fog density at 3'15". Furthermore, each sample was examined for pressure resisting properties (pressure desensitization and pressure marks) by bending at an angle of $\phi=6$ mm prior to exposure and then exposing and developing. The evaluation was as follows:

A: Practicably excellent (excellent)

B: Practicably usable (good)

C: Practicably unusable (poor)

TABLE 1

| | Sample 1 Emulsion (A) | Sample 2 (sample of the invention) Emulsion (B) | Sample 3 Emulsion (C) |
|---|---|---|---|
| Sensitivity | | | |
| 30" | 20 | 130 | 110 |
| 1'15" | 50 | 145 | 135 |
| 3'15" | 100 | 160 | 170 |
| Fog | 0.30 | 0.13 | 0.15 |
| Pressure marks | B | A to B | C |
| Pressure Desensitization | A | A | B to C |

As can be seen from Table 1, the tabular silver chloride emulsion of the present invention is very high in developing speed as compared with the cubic grain emulsion.

The emulsion also has a feature that the sensitivity/-fog ratio after color sensitization is good. Further, it can be seen that the light-sensitive material satisfies the important requirement that the change in performance is small when the material is bent and rubbed.

EXAMPLE 2

Tabular silver chloride grains were formed in the same manner as in the emulsion (B) of Example 1. Then potassium bromide was added in an amount of $1\times10^{-2}$ mol per mol of silver chloride to form a layer of silver bromochloride in a localized form in the neighborhood of the surface of grain. Then chemical sensitization was applied in the same manner as in Example 1 to obtain an emulsion (D).

To the emulsions (A), (B), and (D) were added the following compounds.

Blue-sensitive sensitizing dye (a)

Yellow coupler (b)

Color image stabilizer (c)

Yellow coupler

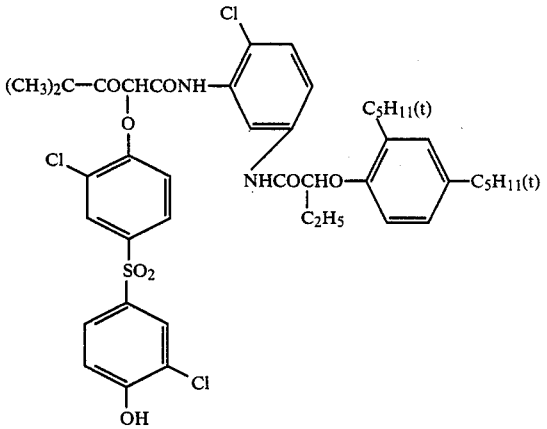

Color image stabilizer

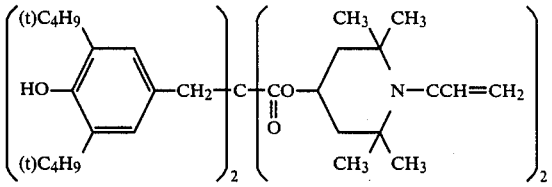

Blue-sensitive sensitizing dye

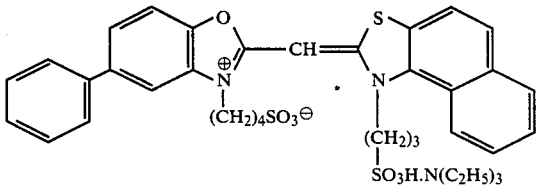

The the following compounds were added in the order.

Stabilizer: 4-hydroxy-6-methyl-1,3,3a,7-tetraazaindene

Antifoggant: 1-phenyl-5-mercaptotetrazole

Hardening agent: 2,4-dichloro-6-hydroxy-s-triazine sodium

Coating aid: Sodium dodecylbenzenesulfonate

The resulting mixture was coated on a paper support, both sides of which had been laminated with polyethylene along with a protective layer, to obtain samples 4, 5, and 6.

Each sample was exposed wedgewise and developed according to the process shown below, with the results shown in Table 2.

The relative sensitivity indicates a reciprocal value of an exposure amount necessary to provide a density of fog +0.1 and is indicated with respect to that at 3'30" of sample 4 being taken as 100.

As can be seen from Table 2, the emulsions (B) and (D) prepared using the compounds of the present invention are of high sensitivity as compared with the comparative emulsion (A) and further is very high in developing speed, and thus is suitable for rapid processing.

TABLE 3

| Developing time | Relative sensitivity: Sample 4* Emulsion (A) | Sample 5 Emulsion (B) | Sample 6 Emulsion (D) |
|---|---|---|---|
| 30" | 12 | 65 | 130 |
| 1' | 60 | 120 | 240 |
| 3'30" | 100 | 150 | 300 |

| Color developer: developing temperature 33° C. | |
|---|---|
| Water | 800 ml |
| Diethylenetriaminepentaacetic acid | 1.0 g |
| Sodium sulfite | 0.2 g |
| N,N—Diethylhydroxylamine | 4.2 g |
| Potassium bromide | 0.01 g |
| Sodium chloride | 1.5 g |
| Triethanolamine | 8.0 g |
| Potassium carbonate | 30 g |
| N—ethyl-N—(β-methanesulfonamidoethyl)-3-methyl-4-aminoaniline sulfuric acid salt | 4.5 g |
| 4,4'-Diaminostylben-based brightening agent (Whitex 4 produced by Sumitomo Chemical Co., Ltd.) | 2.0 g |
| Water to make | 1,000 ml |
| The pH was adjusted to 10.25 with KOH. | |
| **Formation of Bleach-Fixing Solution: 35° C., 45 seconds** | |
| Ammonium thiosulfate (54 wt %) | 150 ml |
| $Na_2SO_3$ | 15 g |
| $NH_4$ Fe(III)(EDTA) | 4 g |
| Glacial acetic acid | 8.61 g |
| Water to make | 1,000 ml |
| (pH 5.4) | |
| **Formulation of Rinsing Solution: 35° C., 90 seconds** | |
| EDTA.2Na.$H_2O$ | 0.4 g |
| Water to make | 1,000 ml |
| (pH 7.0) | |

*examples of the invention

While the invention has been described in detail and with reference to specific embodiments thereof, it will be apparent to one skilled in the art that various changes and modifications can be made therein without departing from the spirit and scope thereof.

What is claimed is:

1. A photographic silver halide emulsion comprising high silver chloride content tabular grains wherein at least 50 mol% of the silver halide is a chloride and at least 50%, based on the total projected area of emulsion grains, are the tabular grains having a ratio of diameter corresponding to a circle of the projected area to thickness of from 3/1 to 8/1.

2. A photographic silver halide emulsion as in claim 1, wherein the silver chloride content of the silver halide is not less than 70 mol%.

3. A photographic silver halide emulsion as in claim 1, wherein the silver chloride content of the silver halide is not less than 90 mol%.

4. A photographic silver halide emulsion as in claim 1, wherein the average volume weighted by volume of silver halide grains is not more than 0.8 $\mu m^3$.

5. A photographic silver halide emulsion as in claim 1, wherein a layer comprising mainly silver bromide is localized on the surface of the silver halide grains.

6. A photographic silver halide emulsion as in claim 5, wherein the amount of the silver bromide in the layer comprising mainly silver bromide is from 0.01 to 10 mol% based on the total silver halide.

7. A photographic silver halide emulsion as in claim 1, wherein the high silver chloride content tabular grains are formed in the presence of a compound represented by formula (I)

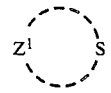

(I)

wherein $Z^1$ is an atomic group forming a substituted or unsubstituted saturated or unsaturated heterocyclic ring in combination with a sulfur atom.

8. A photographic silver halide emulsion as in claim 1, wherein the high silver chloride content tabular grains are formed in the presence of a compound represented by formula (II)

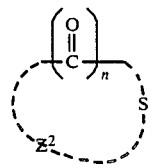

(II)

wherein $Z^2$ represents an unsubstituted or substituted atomic group forming a 5- or 6-membered saturated or unsaturated heterocyclic ring in combination with a sulfur atom and a carbonyl group, and n represents 1, 2, or 3.

9. A photographic silver halide emulsion as in claim 1, wherein the high silver halide chloride content tabular grains are subjected to spectral sensitization using a sensitizating dye represented by formula (Ia)

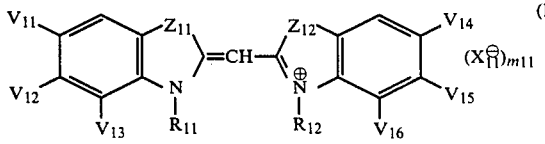

(Ia)

wherein $Z_{11}$ is an oxygen atom, a sulfur atom, or a selenium atom, and $Z_{12}$ is a sulfur atom or a selenium atom;

$R_{11}$ and $R_{12}$ are substituted or unsubstituted alkyl or alkenyl groups having not more than 6 carbon atoms, provided that one of $R_{11}$ and $R_{12}$ is a sulfo substituted alkyl group;

$V_{11}$ is a hydrogen atom, or an alkoxy or alkyl group having not more than 4 carbon atoms;

$V_{14}$ is a hydrogen atom, an alkoxy group having not more than 4 carbon atoms, or alkyl group having not more than 5 carbon atoms;

when $Z_{11}$ is an oxygen atom, $V_{12}$ represents a phenyl group, or $V_{12}$ and $V_{13}$ are linked to each other to form a condensed benzene ring;

when $Z_{11}$ is a sulfur atom or a selenium atom, $V_{12}$ represents an alkoxy group having not more than 4 carbon atoms, a substituted or unsubstituted phenyl group, or a chlorine atom, or $V_{12}$ and $V_{13}$ are linked to each other to form a condensed benzene ring;

when $Z_{12}$ is a selenium atom, $V_{15}$ represents an alkoxy group having not more than 4 carbon atoms, a chlorine atom, or a substituted or unsubstituted phenyl group, or $V_{15}$ and $V_{16}$ are linked to each other to form a condensed benzene ring;

when $Z_{12}$ is a sulfur atom, $V_{15}$ represents a substituted or unsubstituted phenyl group, or $V_{15}$ and $V_{16}$ are linked to each other to form a condensed benzene ring;

$X_{11}^{\ominus}$ is an acid anion radical; and $m_{11}$ is 0 or 1.

10. A photographic silver halide emulsion as in claim 1, wherein the high silver halide content tabular grains are subjected to spectral sensitization using a sensitizing dye represented by formula (IIa)

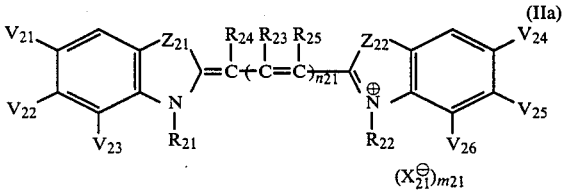

(IIa)

wherein $Z_{21}$ and $Z_{22}$ are each an oxygen atom, a sulfur atom, a selenium atom, or N-$R_{26}$;

$R_{21}$ and $R_{22}$ are substituted or unsubstituted alkyl or alkenyl groups having not more than 6 carbon atoms, provided that one of $R_{21}$ and $R_{22}$ is a sulfo substituted alkyl group, but when $n_{21}$ is 2 or 3, cannot be a sulfo group having substituents at the same time;

when at least one of $Z_{21}$ and $Z_{22}$ is N-$R_{26}$, $R_{23}$ is a hydrogen atom; when neither $Z_{21}$ nor $Z_{22}$ is N-$R_{26}$, $R_{23}$ is a lower alkyl group or a phenetyl group; when $n_{21}$ is 2 or 3, different $R_{23}$ groups are linked to each other to form a 5- or 6-membered ring;

$R_{24}$ and $R_{25}$ are each a hydrogen atom;

when $Z_{21}$ is an oxygen atom, $V_{21}$ is a hydrogen atom; when $Z_{21}$ is a sulfur atom or a selenium atom, $V_{21}$ is a hydrogen atom, an alkyl group having not more than 5 carbon atoms, or an alkoxy group having not more than 5 carbon atoms; when $Z_{21}$ is N-$R_{26}$, $V_{21}$ is a hydrogen atom or a chlorine atom;

when $Z_{22}$ is an oxygen atom, $V_{22}$ is a hydrogen atom; when $Z_{22}$ is a sulfur atom or a selenium atom, $V_{22}$ is a hydrogen atom, an alkyl group having not more than 5 carbon atoms, or an alkoxy group having not more than 5 carbon atoms; when $Z_{21}$ is N-$R_{26}$, $V_{22}$ is a hydrogen atom or a chlorine atom;

when $Z_{21}$ is N-$R_{26}$, $V_{22}$ represents a chlorine atom, a trifluoromethyl group or a cyano group;

when $Z_{22}$ is N-$R_{26}$, $V_{25}$ represents a chlorine atom, a trifluoromethyl group or a cyano group;

when $Z_{21}$ is an oxygen atom, a sulfur atom, or a selenium atom, $V_{22}$ represents an alkoxy group having not more than 5 carbon atoms or a substituted or unsubstituted phenyl group, or $V_{22}$ and $V_{23}$ are linked to each other to form a condensed benzene ring;

when $Z_{22}$ is an oxygen atom, a sulfur atom, or a selenium atom, $V_{25}$ represents an alkoxy group having not more than 5 carbon atoms or a substituted or unsubstituted phenyl group, or $V_{25}$ and $V_{26}$ are linked to each other to form a condensed benzene ring;

further, when $Z_{21}$ is an oxygen atom, $V_{21}$ and $V_{22}$ are linked to each other to form a condensed benzene ring; when $Z_{22}$ is an oxygen atom, $V_{25}$ and $V_{24}$ are linked to each other to form a condensed benzene ring;

$V_{26}$ is a hydrogen atom;

$X_{21}^{\ominus}$ is an acid anion radical;

$m_{21}$ is 0 or 1; and $n_{21}$ is 1 or 2.

11. A photographic silver halide emulsion as in claim 1, wherein the high silver halide chloride content tabular grains are subjected to spectral sensitization using a sensitizing dye represented by formula (IIIa)

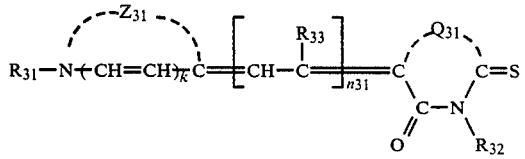

(IIIa)

wherein $Z_{31}$ is an atomic group to form a substituted or unsubstituted heterocyclic nucleus selected from thiazoline, thiazole, benzothiazole, naphthothiazole, selenazoline, selenazole, benzoselenazole, naphthoselenazole, benzimidazole, naphthoimidazole, oxazole, benzoxazole, naphthooxazole, and pyridine;

$R_{33}$ is a hydrogen atom, an alkyl group having not more than 5 carbon atoms, a phenetyl group, a phenyl group, or a 2-carboxyphenyl group;

$R_{31}$ and $R_{32}$ are substituted or unsubstituted alkyl or alkenyl groups having not more than 6 carbon atoms, provided that one of $R_{31}$ and $R_{32}$ is a sulfo substituted alkyl group;

$Q_{31}$ is a sulfur atom or N-$R_{34}$;

$n_{31}$ is 0, 1, or 2; and k is 0 or 1.

12. A color printing paper having formed thereon at least one layer comprising a photographic silver halide emulsion wherein at least 50 mol% of the silver halide is a chloride and at least 50%, based on the total projected area of emulsion grains, are tabular grains having a ratio of diameter corresponding to a circle of the projected area to particle thickness of from 2/1 to 10/1.

13. A color printing paper as in claim 12, wherein as a magenta coupler at least one coupler selected from a 5-pyrazolone coupler, a pyrazolobenzimidazole coupler, a pyrazolotriazole coupler, and a pyrazolotetrazole coupler, and as the cyan coupler, at least one coupler selected from a coupler having an ethyl group in the meta-position of a phenolic nucleus, a 2,5-diacylamino substituted phenolic coupler, a phenolic coupler having an acylamino group in the 5-position and a phenylureido group in the 2-position, and a coupler substituted by a sulfonamide group or an amide group in the 5-position of a naphtholic group is used.

* * * * *